US006530398B1

(12) United States Patent
Westerkamp

(10) Patent No.: US 6,530,398 B1
(45) Date of Patent: Mar. 11, 2003

(54) MULTI-LAYER PAPER MACHINE WIRE WITH WEFT BINDING YARNS

(75) Inventor: Arved H. Westerkamp, Heidenheim (DE)

(73) Assignee: Voith Fabrics Heidenheim GmbH & Co. KG (DE)

( * ) Notice: Subject to any disclaimer, the term of this patent is extended or adjusted under 35 U.S.C. 154(b) by 0 days.

(21) Appl. No.: 09/470,557

(22) Filed: Dec. 22, 1999

(30) Foreign Application Priority Data

Dec. 22, 1998 (DE) ..... 198 59 582

(51) Int. Cl.[7] ..... D03D 13/00; D03D 15/00; D21F 1/00

(52) U.S. Cl. ..... 139/383 A; 139/411; 139/412

(58) Field of Search ..... 139/383 A, 411, 139/412

(56) References Cited

U.S. PATENT DOCUMENTS 4,259,394 A 3/1981 Khan ..... 428/229
4,467,839 A 8/1984 Westhead ..... 139/383 A
5,358,014 A * 10/1994 Kovar ..... 139/383 A
5,601,691 A * 2/1997 Kufferath ..... 139/383 AA
5,944,062 A * 8/1999 Gampe ..... 139/383 A
6,158,478 A * 12/2000 Lee et al. ..... 139/383 A
6,189,577 B1 * 2/2001 Lee ..... 139/383 A

* cited by examiner

*Primary Examiner*—John J. Calvert
*Assistant Examiner*—Andrew Falik
(74) *Attorney, Agent, or Firm*—Gifford, Krass, Groh, Sprinkle, Anderson & Citkowski, P.C.

(57) ABSTRACT

A multi-layer paper machine wire includes an upper fabric layer, a lower fabric layer and an additional layer disposed between the upper and lower fabric layers. The additional layer includes weft threads that alternate with binding threads. Warp threads of the upper fabric layer run over the weft threads of the additional layer and are interwoven with binding threads of the additional layer. Likewise, weft threads of the lower fabric layer run below the weft threads of the additional layer and are interwoven with binding threads of the additional layer.

12 Claims, 3 Drawing Sheets

MULTI-LAYER PAPER MACHINE WIRE WITH WEFT BINDING YARNS

BACKGROUND OF THE INVENTION

The invention relates to a three layer of multi-layer paper machine wire in form of a composite fabric for the wet end of a paper making machine, comprising a three layer or multi-layer paper machine wire in form of a compound fabric for the wet end of the paper machine, comprising at least on upper fabrics on the paper side, at least one lower fabric on the running side and binding threads directed cross to the running direction of the wire, by which the upper fabric and the lower fabric have been connected by weaving.

Known paper machine wires of such a kind have the object to dewater the fiber suspension and to form thereby a stabilized wet paper web which can be carried on the paper machine wire to the press section of the paper machine. For that purpose the paper machine wire has the form of an endless belt circulating within the roll system or dewatering system, respectively of the wet end of the paper machine with high speed.

From practice paper machine wires of the above mentioned kind are known. These wires, which are also called paper machine forming fabrics, comprise on their paper side a very fine fabric, in the following called upper fabric, preferably woven in plain weave, and on their running side directed to the paper machine a wearing fabric, in the following called lower fabric, and corresponding with respect to its warp thread number and weft thread number preferably those of the upper fabric. The lower fabric is generally manufactured with a satin binding or twill binding. The upper and the lower fabrics are connected by binding threads extending for instance cross to the running direction of the wire. Under operation of such paper machine wires on especially modem paper machines operating with high speed often waves are formed in the fabric causing essential reductions of the quality of the manufactured paper.

SUMMARY OF THE PRESENT INVENTION

Therefore, the main object underlying the present invention is to provide the paper machine wire of the above mentioned kind the stability of which in cross direction is improved.

It is a further object of the invention to improve the dewatering characteristics of the fabric and in this connection its permeability.

According to still a further object of the invention the paper machine wire is to be provided with a greater volume.

These and other objects are solved according to the present invention by providing a paper machine wire comprising an additional group of weft threads provided between the weft thread layer of the at least one upper fabric and the weft thread layer of the at least one lower fabric.

Because of the above mentioned features the paper machine wire gets an increased bending strength in cross-direction, ie. cross to its running direction. Thus, the paper machine wire comprises a greater volume having an advantageous effect on the formation of the paper dependant on the construction of the forming section of the paper machine. A greater volume may also result, however, in an improvemed permeability of the fabric so that dewatering of the fiber suspension will be more rapidly by using such a wire.

According to an advantageous embodiment of the subject invention the weft thread layer of the at least one upper fabric and the weft thread layer of the at least one lower fabric are separated from one another by additional weft thread groups. Thus, the upper layer is lifted from the lower layer so that an additional increase of the volume of the paper machine wire and of the stiffness or stability of the wire is caused.

According to a further advantageous embodiment of the subject invention the threads of the additional weft thread group and the binding threads woven between the at least one upper fabric and the at least one lower fabric change with respect to one another. Because of this the additional weft thread group causes an approved protection of the interwoven binding threads in cross-direction, as the upper fabric and the lower fabric are no longer exclusively separated by the binding threads which are binding through but also by the additional weft thread group. Moreover, the positioning stability of the binding threads in longitudinal direction or binding direction of the wire is improved thereby.

According to a further embodiment of the invention all weft threads of the upper fabric run over the threads of the additional group of weft threads and all warp threads of the lower fabric run below the threads of the additional group of weft threads. For that reason a clear separation of the layers is gained, i.e. a clear separation of the upper fabric and the lower fabric, so that the threads of the upper fabric do not directly bind into the lower fabric and the threads of the lower fabric do not directly bind into the upper fabric.

Moreover, it is advantageous to put the threads of the welt layer of the at least one upper fabric, the threads of the weft layer of at least the one lower fabric and the threads of the additional group of weft threads in one and the same approximately vertical level in order to gain a clear separation between the threads of the weft layer of the upper fabric and those of the weft layer of the lower fabric.

According to a further advantageous embodiment of the subject invention the threads of the additional group of weft threads are in vertical direction displaced with respect to the threads of the weft layer of the at least one upper fabric and the threads of the weft layer of the at least one lower fabric. By such an arrangement of the additional group of weft threads not only the bending strength of the wire is increased but also in addition to that the permeability of the wire is reduced. Thus, these properties of the wire may be precisely set by the arrangement of the additional weft thread group according to the invention.

BRIEF DESCRIPTION OF THE INVENTION

A more detailed understanding of the invention will be had with reference to the attached drawings wherein like reference numbers refer to like parts throughout and in which.

DETAILED DESCRIPTION OF THE PRESENT INVENTION

Figure 1:
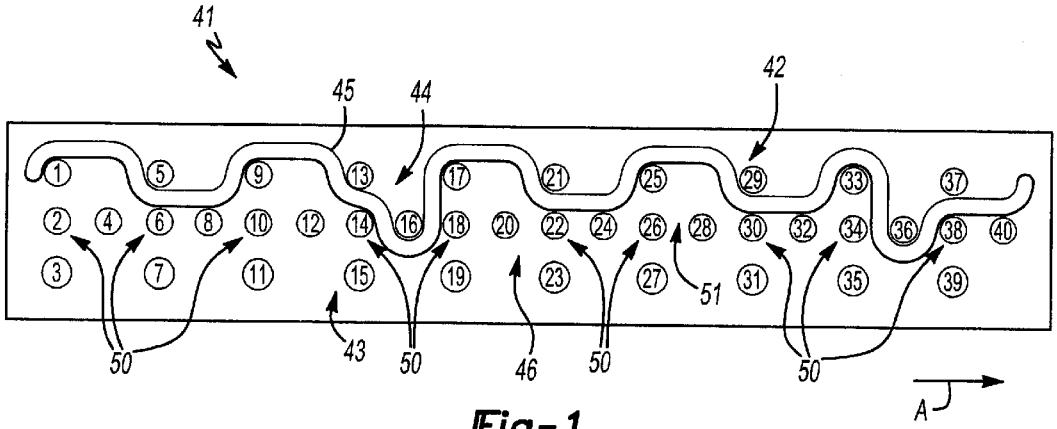
FIG. 1 is a schematical longitudinal sectional view of a three-layer paper machine wire including a warp thread of an upper fabric layer constructed in accordance with a first embodiment.
Figure 2:
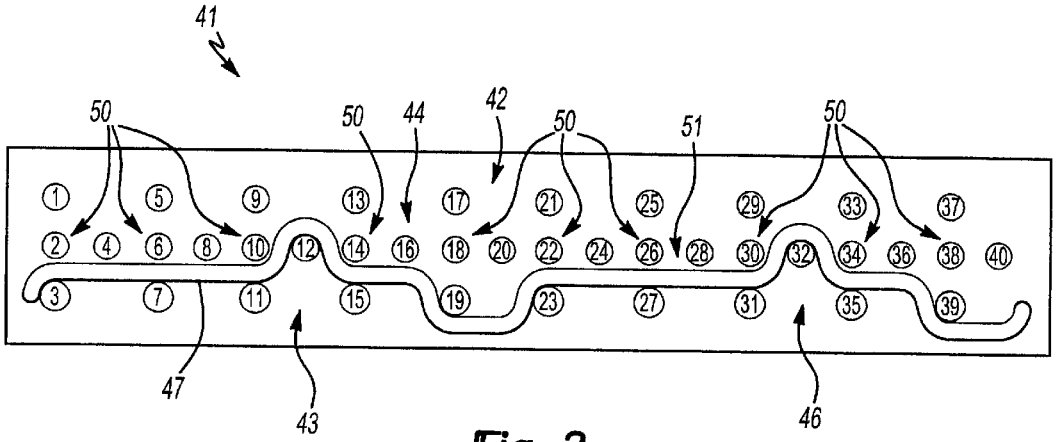
FIG. 2 is another schematical longitudinal sectional view of the three-layer paper machine wire showing a warp thread of a lower fabric layer in accordance with the first embodiment.

FIG. 1 shows a schematical longitudinal section of a part of a three-layer paper machine wire 41 in form of a composite fabric for the wet end of a paper machine not shown in accordance with a first embodiment. This longitudinal section is also called weft section. FIG. 2 shows another longitudinal section of the paper machine wire 41 concerning this first embodiment.

The three-layer paper machine wire 41 is provided with an upper fabric 42 on the paper side and an lower fabric 43 on the running side. The upper fabric 42 comprises a weft layer provided with the weft threads 1, 5, 9, 13, 17, 21, 25, 29, 33, and 37 as well as certain warp threads, of which in FIG. 1 only one thread, namely the warp thread 45 is shown.

The lower fabric 43 comprises the weft layer 46 provided with the weft threads 3, 7, 11, 15, 19, 23, 27, 31, 35, and 39 as well as certain warp threads, of which in FIG. 2 only one thread is shown, namely the warp thread 47.

Cross or transverse to the running direction as shown by the arrow A in FIG. 1 there are certain binding threads 4, 8, 12, 16, 20, 24, 28, 32, 36, and 40 between the weft layer 44 of the upper fabric 42 and the weft layer 46 of the lower fabric 43 in accordance with FIGS. 1 and 2 by which the upper fabric and the lower fabric 42, 43 are woven together and thus connected.

In accordance with the invention between the weft layer 44 of the upper fabric 42 and the weft layer 46 of the lower fabric 43 an additional group 40 of weft threads has been interwoven such that the weft layers 44, 46 are separated from one another by the additional group 50 of weft threads as can be seen from FIGS. 1 and 2. The additional group 50 of weft threads is comprised in FIGS. 1 and 2 the threads 2, 6, 10, 14, 18, 22, 26, 30, 34, and 38. In accordance with FIGS. 1 and 2 the threads of the additional group 50 of weft threads and the binding threads interwoven with the upper fabrics 42 and the lower fabric 43 are changing with respect to one another within the center layer 51 of the paper machine wire 41.

In accordance with a preferred embodiment of the invention, all warp threads of the upper fabric 42 of which in FIG. 1 only the warp thread 45 is shown, run over the threads of the additional group 50 of weft threads and all warp threads of the lower fabric 43 of which in FIG. 2 only the warp thread 47 is shown, run below the threads of the additional group 50 of weft threads. In accordance with the binding phase as shown in FIG. 2 the warp thread 47 of the lower fabric 43 is interwoven in this binding phase only with the binding threads 12 and 32 in the center layer 51.

The reference numerals of the threads 1–40 cross to the running direction as shown by arrow A in FIG. 1 are joined in accordance with the succeding threads concerning this embodiment of the invention. It goes without saying that it is possible to take another sequence of threads which do not correspond to that one as shown in FIGS. 1 and 2. From FIGS. 1 and 2 can be further gathered that at least the threads of the weft layer 44 of the upper fabric 2 have a less diameter than the threads of the weft layer 46 of the lower fabric 43. The diameter of the threads 2, 6, 10, 14, 18, 22, 26, 30, 34, and 38 of the additional weft thread group 50 is about 0.13–0.25 mm The diameter of the binding threads 4, 8, 12, 16, 20, 24, 28, 32, 36, and 40 is about between 0.10 and 0.20 mm.

In accordance with the first embodiment of the invention as shown in FIGS. 1 and 2 the threads of the weft layer 44 of the upper fabric 42 as well as the threads of the weft layer 46 of the lower fabric 43 and the threads of the additional weft thread group 50 are located in a common nearly vertical level and thus nearly one upon the other as can be gathered for instance from the threads 1, 2 and 3 extending cross to the running direction of the wire.

Figure 3:
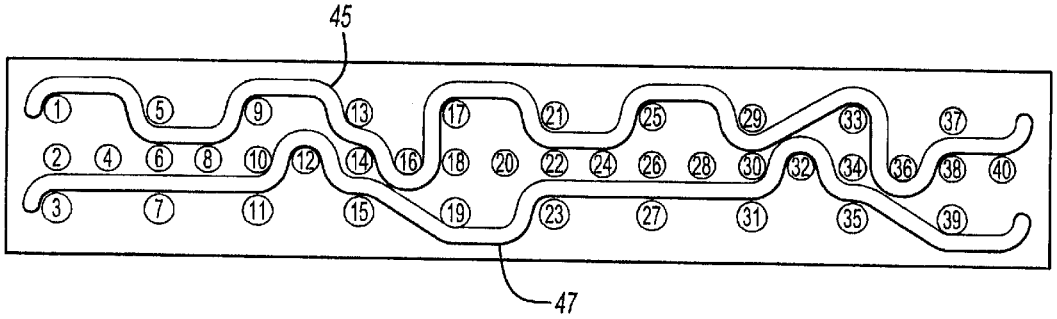
FIG. 3 is a schematical longitudinal sectional view of a three-part paper machine wire in accordance with the first embodiment.
Figure 4:
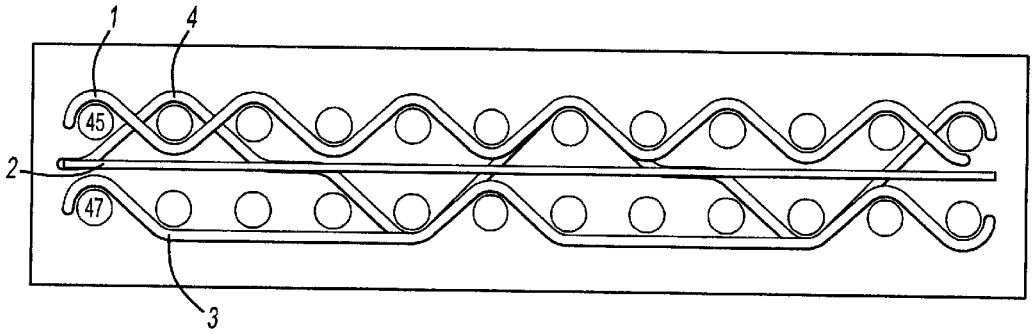
FIG. 4 is a schematical cross-directional view of a three-layer paper machine wire including a binding thread in accordance with the first embodiment.
Figure 5:
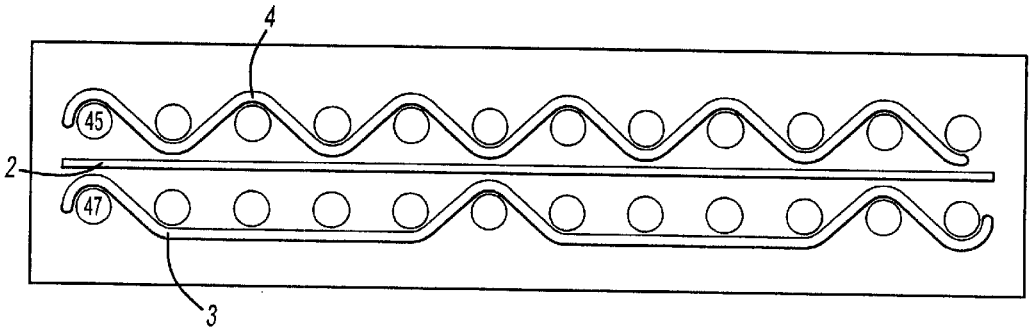
FIG. 5 is a schematical cross-directional sectional view of the three-layer paper machine wire absent the binding threads.
Figure 6:
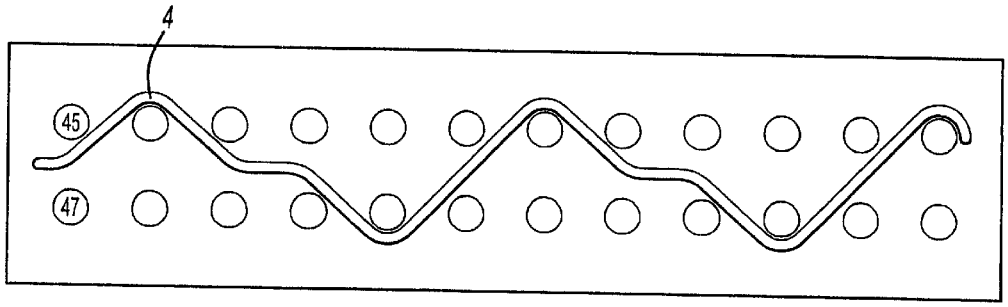
FIG. 6 is a schematical cross-directional sectional view of a three-layer paper machine wire with the weft threads removed.
Figure 7:
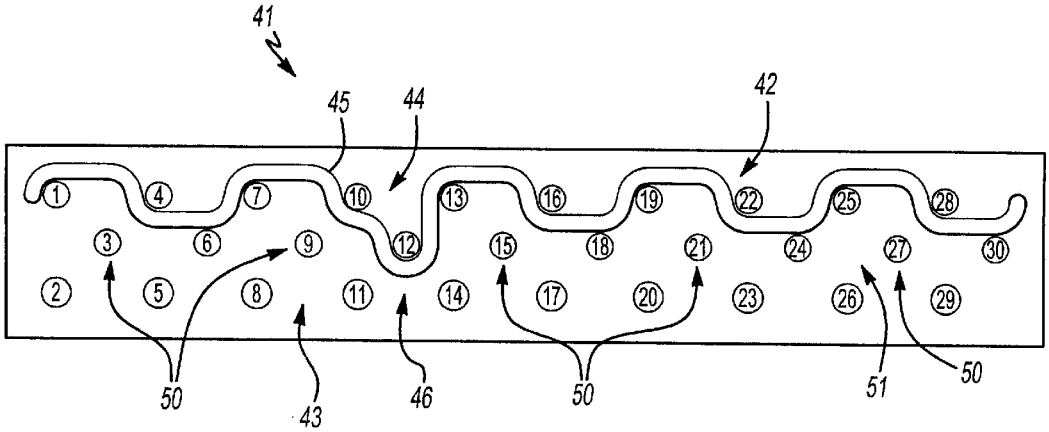
FIG. 7 is a schematical longitudinal sectional view of a three-layer paper machine wire in accordance with a second embodiment.
Figure 8:
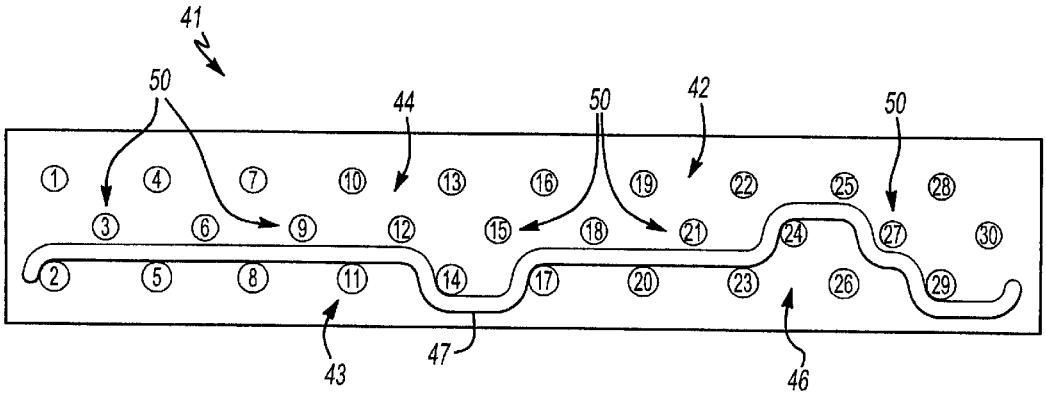
FIG. 8 is a schematical longitudinal sectional view of a three-layer paper machine wire in accordance with a second embodiment.

FIGS. 3 and 4 show a second embodiment of the paper machine wire 41 in accordance with the invention on which the upper fabric 42 is provided with a weft layer 44 comprising the weft threads 1, 4, 7, 11, 13, 16, 19, 22, 25, and 28 and certain warp threads, of which only the warp thread 45 is shown in FIG. 3. The lower fabric 43 is provided with a weft layer 46 comprising the weft threads 2, 5, 8, 11, 14, 17, 20, 23, 26, and 29 and certain warp threads, which in FIG. 4 only the warp thread 47 is shown. The center layer 51 comprises the additional weft thread group 50 having the additional threads 3, 9, 16, 21, and 27 as well as the binding threads 6, 12, 18, 24, and 30. Thus, in this embodiment, too the threads of the additional weft thread group 50 are alternating with the binding threads interwoven in the upper fabric 42 and lower fabric 43.

In contrast to the first embodiment, the threads of the additional group of weft threads of the second embodiment as shown in FIGS. 3 and 4 are displaced in vertical direction with respect to the threads of the weft thread layer 44 of the upper fabric 42 and the threads of the weft thread layer 46 of the lower fabric 43. This can be gathered for instance with respect to thread 1 of the weft thread layer 44 of the upper fabric 42 and thread 2 of the weft thread layer 46 of the lower fabric 43 located in the same vertical level or plane, and thread 3 of the additional group 50 of weft threads positioned in a level which is not aligned with the above mentioned common vertical level of the threads 1 and 2 but is displaced thereof The threads of the additional group 50 of weft threads and the binding threads 6, 12, 18, 24, 30 are located in vertical direction between the vertical planes provided by the threads of the weft layers 44 and 46.

The paper machine wire 41 in accordance with the second embodiment as shown in FIGS. 1 and 3 comprises a greater open volume as the paper machine 41 concerning the first embodiment as shown in FIGS. 1 and 2.

It goes without saying that the threads of the additional group 50 of weft threads can also have any other position differing from that one as shown in FIGS. 1–4 so long as they are located between the upper fabric and the lower fabric. Moreover, the position of the warp threads 45, 47 can also be varied to a great extent so that the embodiments as shown are only examples. Furthermore, the paper machine wire can also be comprised of more than three layers.

The paper machine wire in accordance with the invention is provided with an improved stability in cross direction of the fabric, concerning especially double wire machines so that paper manufactured by means of such a kind of wire has a very good quality. Moreover, by avoiding formation of waves in the wire the lifetime thereof is improved.

What is claimed is:

1. A multi-layer paper machine wire comprising:

an upper fabric layer on a paper side of said wire;

a lower fabric layer on a running side of said wire;

an additional layer disposed between said upper fabric layer and said lower fabric layer having a plurality of weft threads and a plurality of binding threads, said weft threads alternating with said binding threads.

2. The paper machine wire of claim 1, wherein said upper fabric layer comprises a warp thread that runs over said plurality of weft threads of said additional layer and said lower fabric layer comprises a warp thread that run below said plurality of weft threads of said additional layer.

3. The paper machine wire of claim 2, wherein said warp thread of said upper layer is interwoven with a binding thread of said plurality of binding threads.

4. The paper machine wire of claim 2, wherein said warp thread of said lower layer is interwoven with a binding thread of said plurality of binding threads.

5. The paper machine wire of claim 1, wherein said upper fabric layer comprises a plurality of weft threads and said lower fabric layer comprises a plurality of weft threads.

6. The paper machine wire of claim 5, wherein said weft threads of said upper fabric layer, said weft threads of said lower fabric layer and said weft threads of said additional layer are positioned in a substantially vertical plane.

7. The paper machine wire of claim 5, wherein said weft threads of said additional layer extend in a vertical direction that is displaced with respect to said weft threads of said upper fabric layer and said weft threads of said lower fabric layer.

8. The paper machine wire of claim 5, wherein said weft threads of said upper fabric layer have a diameter less then said weft threads of said lower fabric layer.

9. The paper machine wire of claim 1, wherein each weft thread of said plurality of weft threads of said additional layer has a diameter between about 0.13–0.25 mm.

10. The paper machine wire of claim 1, wherein each binding thread of said plurality of binding threads of said additional layer has a diameter between about 0.10–0.20 mm.

11. A multi-layer paper machine wire comprising:

an upper fabric layer on a paper side of said wire having a plurality of weft threads and a plurality of warp threads;

a lower fabric layer on a running side of said wire having a plurality of weft threads and a plurality of warp threads;

an additional layer disposed between said upper fabric layer and said lower fabric layer having a plurality of weft threads and a plurality of binder threads, said weft threads alternating with said binding threads, said warp threads of said upper fabric layer running over said plurality of weft threads of said additional layer and said warp threads of said lower fabric layer running below said plurality of weft threads of said additional layer.

12. A multi-layer paper machine wire comprising:

an upper fabric layer on a paper side of said wire having a plurality of weft threads and a plurality of warp threads;

a lower fabric layer on a running side of said wire having a plurality of weft threads and a plurality of warp threads, said weft threads of said lower fabric layer having a diameter greater then said weft threads of said upper fabric layer;

an additional layer disposed between said upper fabric layer and said lower fabric layer having a plurality of weft threads and plurality of binding threads, said weft threads alternating with said binding threads, each weft thread of said plurality of weft threads of said additional layer having a diameter between 0.13–0.25 mm, each binding thread of said plurality of binding threads of having a diameter between 0.10–0.20 mm, said warp threads of said upper fabric layer running over said plurality of weft threads of said additional layer and said warp threads of said lower fabric layer running below said plurality of weft threads of said additional layer.

* * * * *